US006491514B1

(12) United States Patent
Hamad et al.

(10) Patent No.: US 6,491,514 B1
(45) Date of Patent: Dec. 10, 2002

(54) FURNACE BURNER BOX ASSEMBLY WITH REDUCED ACOUSTIC EMISSIONS

(75) Inventors: Nabil George Hamad, Carrollton, TX (US); Darcy Quentin Easterling, Flower Mound, TX (US); Glenn William Kowald, Carrollton, TX (US)

(73) Assignee: Lennox Industries, Inc., Richardson, TX (US)

( * ) Notice: Subject to any disclaimer, the term of this patent is extended or adjusted under 35 U.S.C. 154(b) by 0 days.

(21) Appl. No.: 10/002,579

(22) Filed: Nov. 15, 2001

(51) Int. Cl.[7] ..... F24H 3/02; F23D 14/12

(52) U.S. Cl. ..... 431/114; 126/99 R; 126/112; 126/110 R; 431/188

(58) Field of Search ..... 431/114, 188, 431/284, 352; 126/110 R, 112, 99 R; 60/39.06, 725, 737

(56) References Cited

U.S. PATENT DOCUMENTS

| | | | | |
|---|---|---|---|---|
| 2,150,782 A | | 3/1939 | Vollmer | |
| 3,840,326 A | * | 10/1974 | Schreter | 431/114 |
| 4,417,868 A | | 11/1983 | Putnam | |
| 4,476,850 A | | 10/1984 | Pickering | |
| 5,062,790 A | | 11/1991 | Loberger et al. | |
| 6,126,436 A | | 10/2000 | Cabrera et al. | |

FOREIGN PATENT DOCUMENTS

| | | | | |
|---|---|---|---|---|
| GB | 1274414 | * | 5/1972 | 431/114 |

* cited by examiner

*Primary Examiner*—James C. Yeung
(74) *Attorney, Agent, or Firm*—Gardere Wynne Sewell LLP

(57) ABSTRACT

A burner box assembly for a combustion air furnace includes a back wall, opposed side walls and top and bottom walls defining an interior space for one or more burner nozzles. A combustion air inlet opening is formed in the top wall and is covered by a generally rectangular inverted channel-shaped airflow guide and baffle member. A second generally rectangular box-shaped louvered airflow guide and baffle member is mounted on the interior side of the top wall over the combustion air inlet opening for distributing the flow of combustion air into the burner box assembly and to reduce acoustic emissions from the burner box assembly through the combustion air inlet opening. The combination of the louvered baffle member and the exterior mounted baffle member provides reduced acoustic emissions from the burner box assembly as well as more evenly distributed combustion airflow into and through the burner box assembly.

18 Claims, 4 Drawing Sheets

FURNACE BURNER BOX ASSEMBLY WITH REDUCED ACOUSTIC EMISSIONS

BACKGROUND

In the continued development of air-conditioning furnaces, one important consideration is to reduce acoustic emissions. For example, for forced air gas and oil fired residential air-conditioning furnaces, the furnace itself may be located in the building which is being heated in a location within the building where acoustic emissions are annoying to occupants of the building, or such emissions otherwise interfere with activities in the building. Accordingly, efforts have been made to reduce acoustic emissions caused by the combustion process as well as noise generated by airflow to and through the furnace.

However, prior art efforts to provide properly designed burner and burner box assemblies adapted to reduce acoustic emissions have not provided for as much reduction in such emissions from the burner box as desired without impeding airflow to and around the burners. Provisions for adequate airflow for proper combustion are, of course, important. Also of importance is to provide for the direction of the airflow to be such as to minimize any unwanted convection of heat in a direction which would reduce the thermal efficiency of the furnace. Accordingly, continued improvements in furnace burner box assemblies which provide for reduced acoustic emissions without restricting or misdirecting airflow have been sought. It is to these ends that the present invention has been developed.

SUMMARY OF THE INVENTION

The present invention provides a furnace burner box assembly having reduced acoustic emissions.

In accordance with one aspect of the present invention, a furnace burner box assembly is provided which includes one or more gas or oil-fired burners disposed therein and wherein a top wall of the burner box includes a large inlet opening for combustion air, and a multiple louvered baffle member supported on the underside of the burner box top wall. The burner box assembly also advantageously includes a second baffle member supported on the topside of the burner box top wall for reducing acoustic emissions from the burner box caused by the combustion process and by relatively high-velocity airflow into the burner box and then into the furnace heat exchanger in the combustion region.

The present invention also provides a burner box assembly with reduced acoustic emissions wherein a first baffle member is arranged depending from a top wall of the burner box and is provided with multiple air outlet openings for directing combustion air in a more even distribution through the burner box assembly. Multiple openings in the first baffle member are provided by louvers which form an angle with respect to the baffle bottom wall. The louvers are advantageously oriented to prevent direct or so-called line of sight noise transmission from the burner nozzle outlets to and through the primary combustion air inlet opening in the top wall of the burner box. Accordingly, the combustion air flowing into the burner box assembly is more evenly distributed, flow velocities are reduced and acoustic emissions are substantially prevented from exiting the burner box through the opening in the top wall. Still further, a second baffle member is mounted above the burner box top wall and further reduces acoustic emissions from the burner box assembly without impeding airflow thereto.

Those skilled in the art will further appreciate the above-mentioned advantages and superior features of the invention together with other important aspects thereof upon reading the detailed description which follows in conjunction with the drawings.

DETAILED DESCRIPTION OF A PREFERRED EMBODIMENT

Figure 1:
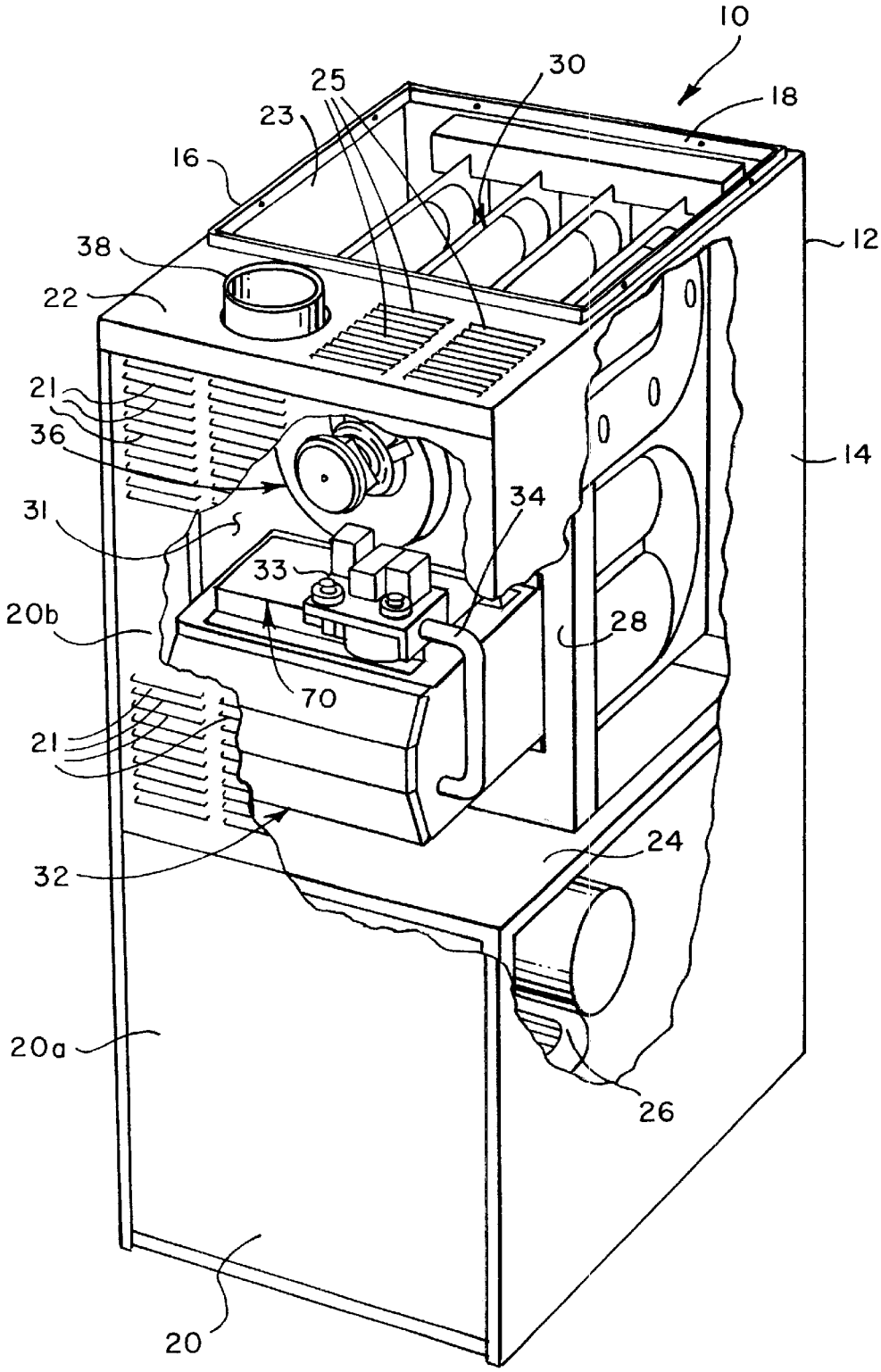
FIG. 1 is a perspective view of a forced air combustion furnace including the improved burner box assembly of the present invention.

In the description which follows, like parts are marked throughout the specification and drawing with the same reference numerals, respectively. The drawing figures are not necessarily to scale and certain features may be shown in simplified or somewhat schematic form in the interest of clarity and conciseness.

Referring to FIG. 1, there is illustrated an improved forced air combustion furnace, generally designated by the numeral 10, and generally of a type typically used in air-conditioning systems for residential dwellings and the like. The improved furnace 10 includes a generally rectangular cabinet 12 having opposed side walls 14 and 16, a back wall 18 and a front wall 20. Front wall 20 may be constructed of separate, generally rectangular panels 20*a* and 20*b*. Front wall 20 and sidewall 14 are partially broken away for purposes of illustration. A top wall 22 extends between side walls 14 and 16 and between front wall panel 20*b* and a large rectangular opening 23 comprising a supply air discharge opening. A generally horizontally extending partition 24 is provided in cabinet 12 and partially encloses a supply air blower 26 and suitable controls therefor. A vertically extending intermediate partition 28 is disposed generally between partition 24 and top wall 22 and forms the front wall of a heat exchanger enclosure for a heat exchanger, generally designated by the numeral 30.

A somewhat enclosed space 31 is formed between walls 14, 16, 22, 24, partition 28 and removable front panel 20*b* for a burner box assembly 32. Burner box assembly 32 is suitably mounted on partition 28. A conventional fuel control valve 33 and fuel supply conduit 34 are mounted on burner box assembly 32 and, forming no part of the present invention, will not be discussed in detail herein. Enclosed space 31 is also partially occupied by a combustion air blower 36 for drawing combustion air through the interior of the heat exchanger 30 and for discharge of combustion products through a flue pipe 38. As shown in FIG. 1, at least removable panel 20*b* and top wall 22 are provided with multiple air inlet openings 21 and 25 formed by suitable louvers, as illustrated, for admitting combustion air to the space 31 and burner box assembly 32.

Figure 2:
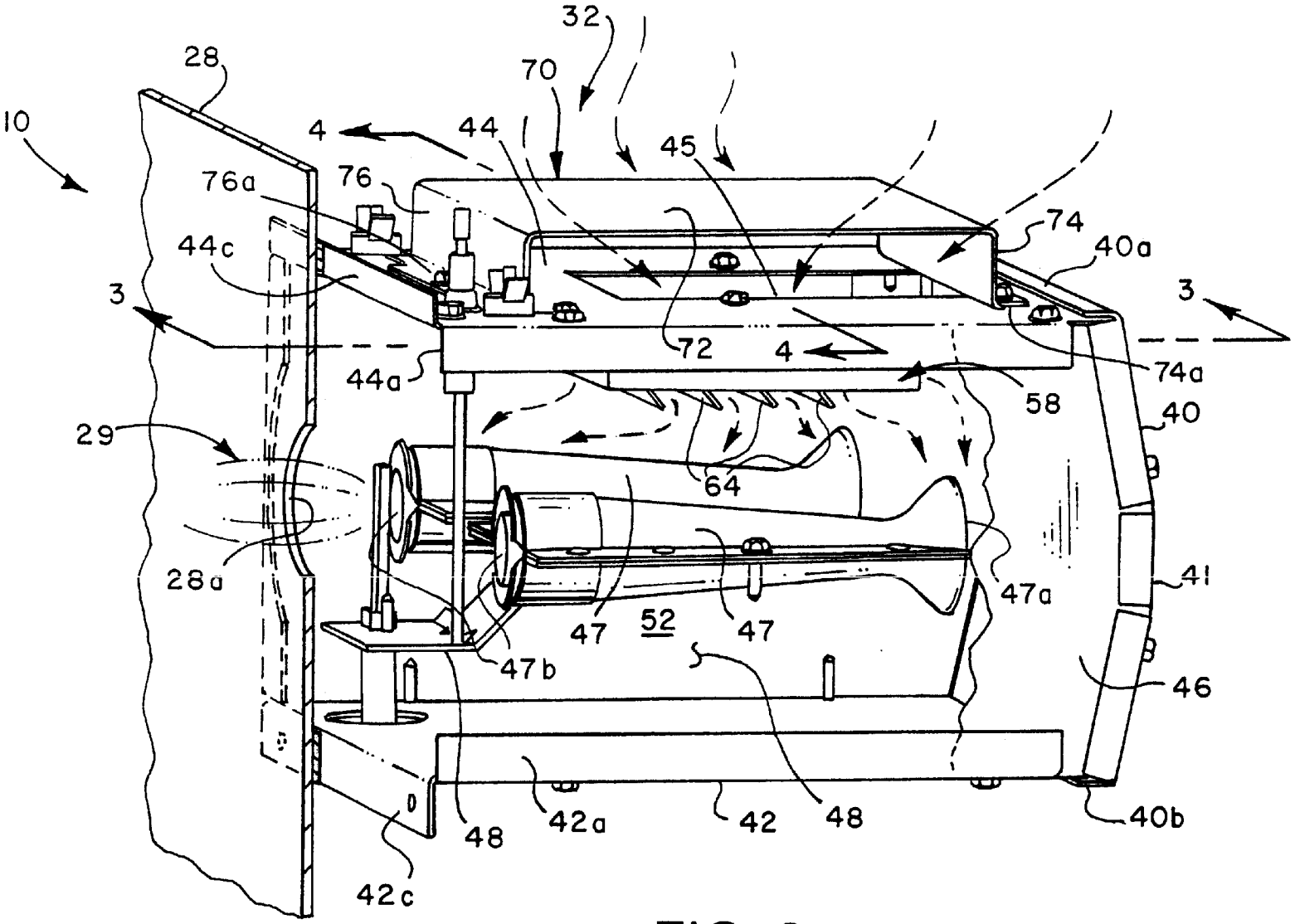
FIG. 2 is a perspective view of the furnace burner box assembly for a furnace, such as shown in FIG. 1.
Figure 3:
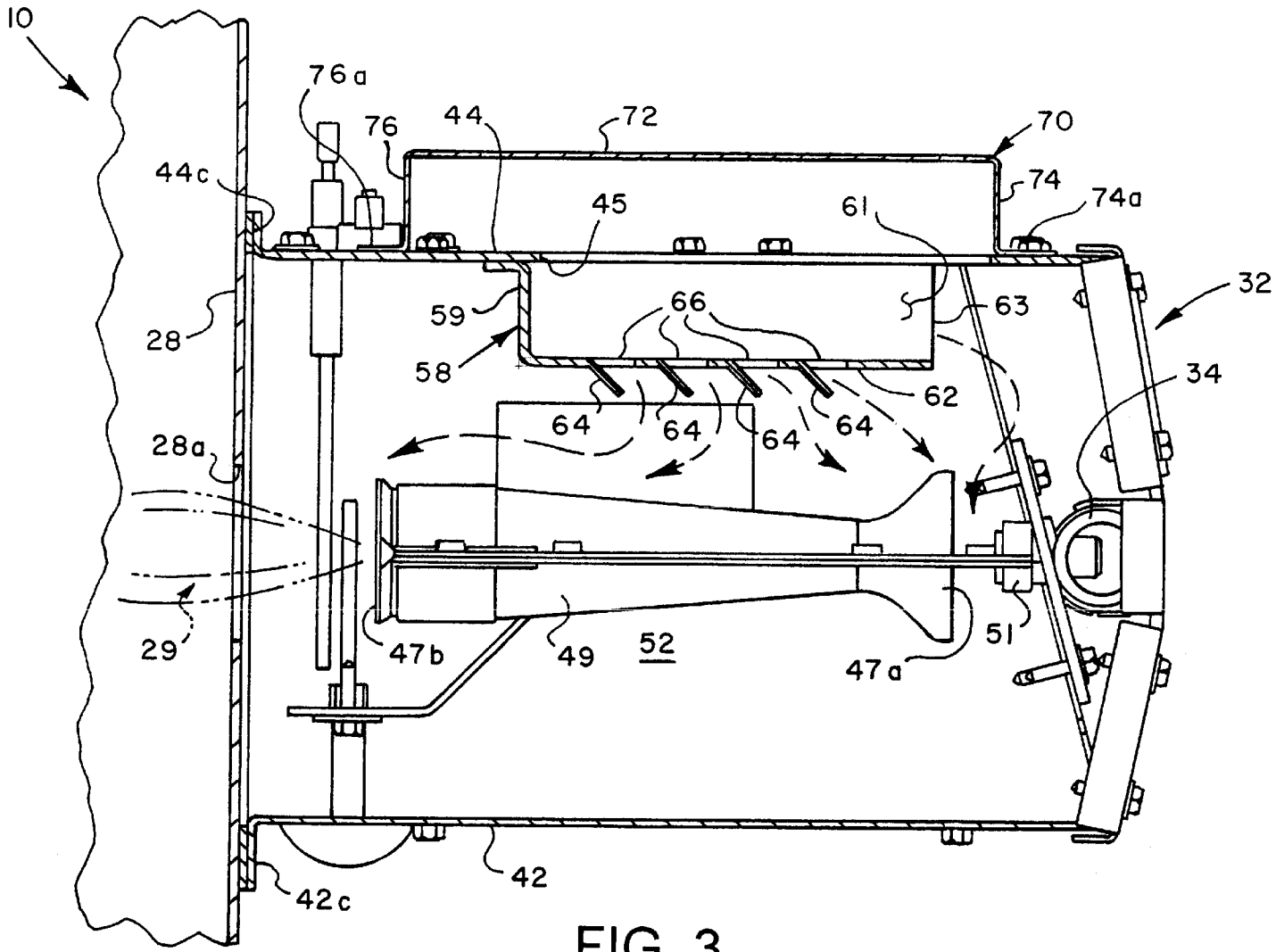
FIG. 3 is a section view taken generally along the line 3—3 of FIG. 2.
Figure 4:
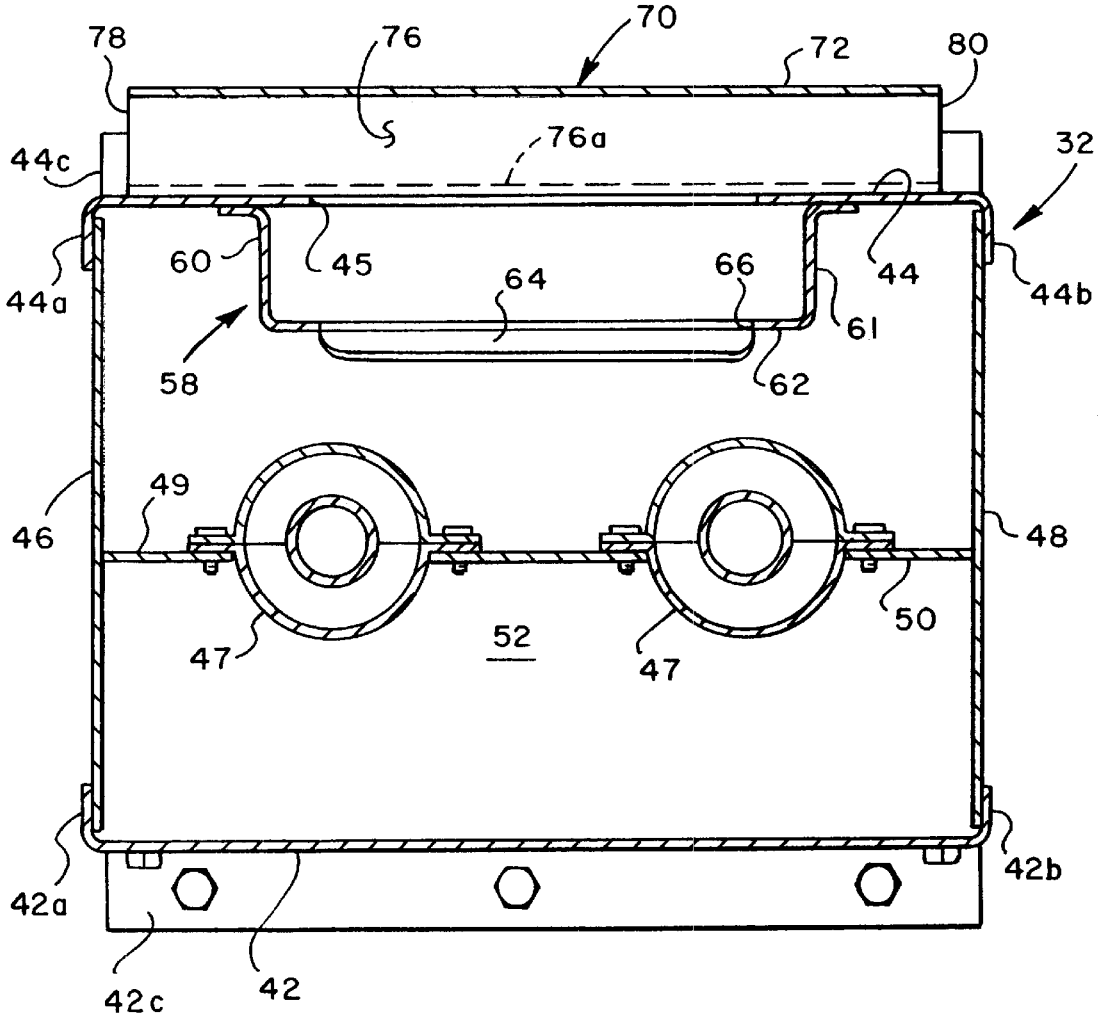
FIG. 4 is a section view taken generally along the line 4—4 of FIG. 2.

Referring now to FIGS. 2, 3 and 4, the burner box assembly 32 is characterized by a pitched back wall 40 including a generally flat vertically extending crown section 41 and opposed flanges 40*a* and 40*b*, FIG. 2. Burner box assembly 32 further includes a planar bottom wall 42 having opposed upturned flanges 42*a* and 42*b*, FIG. 4, and a downturned distal flange 42*c*, FIG. 2, extending between the flanges 42*a* and 42*b*. Flange 42*c* comprises a mounting flange for mounting the burner box assembly 32 on the partition 28. As shown in FIGS. 2 and 3, partition 28 includes suitable spaced-apart openings 28*a*, one shown, for receiving combustion air and a flame front or plume 29 of combustion of the fuel being burned in the furnace 10.

Burner box assembly 32 also includes a generally horizontal, planar top wall 44 having opposed downturned flanges 44*a* and 44*b*, FIG. 4, and an upturned transverse flange 44*c*, FIGS. 2 and 3. Still further, burner box assembly 32 includes opposed, parallel and generally planar side walls 46 and 48 which extend between the bottom and top walls 42 and 44 and are connected thereto at the flanges 42*a*, 44*a* and 42*b*, 44*b* as illustrated. Plural spaced-apart burner nozzles 47 are suitably mounted in burner box assembly 32 by support structure including flanges 49 and 50, see FIG. 4. Burner gas orifices 51, one shown in FIG. 3, are in fluid-flow communication with conduit 34 for receiving fuel therefrom. Burner nozzles 47 each include a bellmouth inlet 47*a* and a diverging discharge port 47*b*, FIGS. 2 and 3, of somewhat conventional construction for mixing fuel with combustion air and supporting a flame front 29 at the discharge port 47*b* and generally within the openings 28*a* of partition 28. Two burner nozzles 47 are shown, although the invention may be used in conjunction with one or more burner nozzles and an appropriately dimensioned burner box assembly.

Referring further to FIGS. 3 and 4, top wall 44 includes a relatively large, rectangular combustion air inlet opening or transfer port 45 formed therein and substantially centrally located between the side walls 46 and 48. Combustion air flows through inlet opening 45 into the interior space 52 of burner box assembly 32 by way of a generally rectangular box-shaped airflow guide and acoustic emissions baffle member 58. Guide and baffle member 58 includes a transverse back wall 59, opposed side walls 60 and 61 and a planar, louvered bottom wall 62. The end of member 58 opposite the back wall 59 is completely open and forms an air inlet port 63 open to the interior 52 of burner box assembly 32. Guide and baffle member 58 is substantially centered between side walls 46 and 48 of the burner box assembly 32 and is disposed so as to cover at least a major portion of the opening 45 in top wall 44. Transverse backwall 59 is advantageously disposed spaced from an adjacent edge of opening 45, as shown in FIG. 3. Spaced-apart louvers 64 depend from bottom wall 62 each at an angle of about 45° with respect to the plane of the bottom wall. Louvers 64 are disposed, respectively, directly adjacent elongated, generally rectangular spaced apart airflow inlet ports 66, respectively, for admitting combustion air to the interior space 52 and generally along the length of the guide and baffle member 58. Louvers 64 also form a reflecting surface for reflecting acoustic emissions from the flame fronts 29, FIG. 3, for each of the burner nozzles 47.

Accordingly, the airflow guide and baffle member 58 substantially prevents transmission of direct or so-called line-of-sight acoustic emissions from the flame fronts 29 or the openings 28*a* from the burner box interior 52 through the combustion air inlet opening or port 45. Still further, the spaced-apart, elongated, rectangular ports 66 provide for distribution of combustion air into the burner box interior space 52 so that some air is drawn into the nozzles 47 through the bellmouth inlets 47*a* while air also flows in an enveloping manner around the nozzles and is drawn through the openings 28*a* in a substantially uniform manner with respect to the central longitudinal axes of the nozzles 47. Thanks also to the provision of the louvered openings 66 and the completely open-end port 63 of the guide and baffle member 58, this member does not require to be extended completely across the space 52 between the side walls 46 and 48. Moreover, a more even distribution of combustion airflow is provided which reduces airflow velocities into the interior space 52 and also reduces or eliminates any acoustic emissions possibly generated thereby.

Referring still further to FIGS. 2, 3 and 4, the burner box assembly 32 includes a second airflow guide and baffle member 70 mounted on and above the top wall 44 as illustrated. Airflow guide and baffle member 70 includes a generally horizontal planar top wall 72 extending between depending front and back walls 74 and 76. Horizontal top wall 72 is spaced above burner box top wall 44 a sufficient distance to provide opposed generally rectangular air inlet openings 78 and 80, FIG. 4, which are set inside of but may also be generally coplanar with the box assembly side walls 46 and 48. Opposed flanges 74*a* and 76*a* are provided for mounting the guide and baffle member 70 on top wall 44 by conventional fasteners, as shown in FIGS. 2 and 3. Guide and baffle member 70 extends over air inlet opening 45, as shown. The cross-sectional flow area of the ports 78 and 80 is, cumulatively, preferably about the same as the total flow area of the ports 66 and the baffle member end port 63. The flow area of port 45 may be greater than the total flow area of ports 78 and 80 or the total flow area of ports 66 and the port 63. In this way, air flowing into the space 52 of burner box assembly 32 is, generally, not accelerated as a consequence of any restrictive flow ports of different sizes which would tend to cause unwanted acceleration of airflow and generate related acoustic emissions.

Accordingly, those skilled in the art will appreciate that the configuration of the burner box assembly 32, including the airflow guide and baffle members 58 and 70 provides for reduced acoustic emissions from the burner box assembly.

Preliminary tests with a burner box assembly configured generally in accordance with drawing FIGS. 1 through 4 and as described herein, have indicated a reduction in sound pressure level in the 125 Hz, one-third octave band of as much as seven to eight decibels as compared with an open burner box assembly for a typical 80% AFUE (Annual Fuel Use Efficiency) furnace.

In operation, combustion air is drawn into the interior space 52 of the burner box assembly 32 in an evenly distributed manner as will be appreciated by those skilled in the art from the foregoing description. Accordingly, not only are acoustic emissions reduced by the configuration of the burner box assembly 32 but combustion air is more evenly distributed and heat losses from the furnace 10 through the burner box assembly are indicated to be reduced.

The burner box assembly 32 may be constructed of conventional engineering materials used for furnace burner box assemblies. For example, back wall 40, bottom wall 42, top wall 44 and guide and baffle members 58 and 70 may be formed of 0.034 inch to 0.038 inch thick aluminized steel and side wall and mounting bracket members 46 and 48 may be formed of 0.045 inch to 0.050 inch thick aluminized or galvanized steel. Conventional mechanical fasteners may be used to assemble the burner box assembly 32 and to mount the burner box assembly on the partition 28. A suitable insulating gasket, not shown, may be disposed between the flanges 42*c* and 44*c* and the partition 28. Conventional flame igniter and roll-out flame sensor elements may be mounted on the burner box assembly 32, but further discussion of same is omitted in the interest of clarity as they form no part of the present invention.

Although a preferred embodiment of the invention has been described in detail, those skilled in the art will recognize that various substitutions and modifications may be made to the invention without departing from the scope and spirit of the appended claims.

What is claimed is:

1. A furnace burner box assembly for a combustion furnace including a partition defining a wall of a heat exchanger enclosure of said furnace, said burner box assembly being mounted at said partition, and said burner box assembly comprising:

a back wall, a top wall, a bottom wall, opposed side walls and an open end;

at least one burner nozzle mounted within an interior space of said burner box assembly;

at least one combustion air inlet opening formed in one of said walls of said burner box assembly for admitting combustion air to said interior space; and a louvered airflow guide and baffle member mounted in said interior space between said combustion air inlet opening and said at least one burner nozzle, said baffle member including opposed side walls and a wall extending between said sidewalls, said walls of said baffle member blocking direct transmission of acoustic emissions from said at least one burner nozzle to said at least one inlet opening, plural spaced apart ports formed in one of said walls and louvers adjacent said ports, respectively, for directing combustion air to said interior space in a distributed manner and for reducing acoustic emissions from said burner box assembly to the exterior thereof.

2. The burner box assembly set forth in claim 1 including:

another airflow guide and baffle member disposed over said combustion air inlet opening to reduce acoustic emissions from said burner box assembly through said combustion air inlet opening.

3. The burner box assembly set forth in claim 2 wherein:

said another baffle member is mounted exterior of said burner box assembly.

4. The burner box assembly set forth in claim 2 wherein:

said combustion air inlet opening is formed in said top wall of said burner box assembly; and said another baffle member is mounted on said top wall of said burner box assembly.

5. A furnace burner box assembly for a combustion furnace including a partition defining a wall of a heat exchanger enclosure of said furnace, said burner box assembly being mounted at said partition, and said burner box assembly comprising:

a back wall, a top wall, a bottom wall, opposed side walls and an open end;

at least one burner nozzle mounted within an interior space of said burner box assembly;

at least one combustion air inlet opening formed in one of said walls of said burner box assembly for admitting combustion air to said interior space; and a multi-louvered guide and baffle member mounted in said interior space and adjacent said combustion air inlet opening for receiving and distributing combustion air admitted to said interior space and for reducing acoustic emissions from said burner box assembly to the exterior thereof, said baffle member including a bottom wall, opposed side walls, an end wall and plural spaced apart ports formed in one of said walls for directing combustion air to said interior space in a distributed manner.

6. The burner box assembly set forth in claim 5 including:

spaced apart louvers adjacent said ports in said one wall of said baffle member, respectively, for directing airflow into said interior space and for deflecting acoustic emissions away from said ports in said one wall.

7. The burner box assembly set forth in claim 5 wherein:

said baffle member includes an open end facing in a direction opposite said partition for admitting at least a portion of combustion air into said burner box assembly adjacent said back wall of said burner box assembly.

8. A furnace burner box assembly for a combustion furnace including a partition defining a wall of a heat exchanger enclosure of said furnace, said burner box assembly being mounted at said partition, and said-burner box assembly comprising:

a back wall, a top wall, a bottom wall, opposed side walls and an open end;

at least one burner nozzle mounted within an interior space of said burner box assembly;

at least one combustion air inlet opening formed in one of said walls of said burner box assembly for admitting combustion air to said interior space;

a multi-louvered guide and baffle member mounted in said interior space and adjacent said combustion air inlet opening for receiving and distributing combustion air admitted to said interior space and for reducing acoustic emissions from said burner box assembly to the exterior thereof; and another airflow guide and baffle member disposed over said combustion air inlet opening to reduce acoustic emissions from said burner box assembly through said combustion air inlet opening, said another baffle member including opposed air inlet ports for admitting combustion air to said combustion air inlet opening.

9. The burner box assembly set forth in claim 8 wherein:

a cross-sectional flow area of said inlet ports in said another baffle member, collectively, is about the same as a total cross sectional flow area provided by said louvered baffle member.

10. A furnace burner box assembly including plural walls and an open end, at least one burner nozzle mounted within an interior space of said burner box assembly, a combustion air inlet opening formed in one of said walls of said burner box assembly for admitting combustion air to said interior space, a first airflow guide and baffle member mounted in said interior space and adjacent said combustion air inlet opening for receiving and distributing combustion air admitted to said interior space, said first baffle member includes plural spaced apart ports formed therein and spaced apart louvers adjacent said ports, respectively, for directing airflow into said interior space and deflecting acoustic emissions away from said ports, and a second airflow guide and baffle member mounted on the exterior of said burner box assembly and adjacent said combustion air inlet opening, said baffle members being arranged to reduce acoustic emissions from said burner box assembly.

11. The burner box assembly set forth in claim 10 wherein:

said first baffle member includes a bottom wall, opposed sidewalls, an end wall and an open end, at least a portion of airflow into said interior space passing through said open end.

12. A furnace burner box assembly including plural walls and an open end, at least one burner nozzle mounted within an interior space of said burner box assembly, a combustion air inlet opening formed in one of said walls of said burner box assembly for admitting combustion air to said interior space, a first airflow guide and baffle member mounted in said interior space and adjacent said combustion air inlet opening for receiving and distributing combustion air admitted to said interior space, and a second airflow guide and baffle member mounted on the exterior of said burner box assembly and adjacent said combustion air inlet opening, said second baffle member including opposed air inlet ports formed thereby for admitting combustion air to said combustion air inlet opening of said burner box assembly, said baffle members being arranged to reduce acoustic emissions from said burner box assembly.

13. An air heating furnace comprising:

a cabinet;

a heat exchanger mounted in said cabinet;

a partition defining a wall of a heat exchanger enclosure of said furnace; and a burner box assembly mounted at said partition, said burner box assembly including a back wall, a top wall, a bottom wall, opposed sidewalls and an open end, at least one burner nozzle mounted within an interior space of said burner box assembly, a combustion air inlet opening formed in one of said walls of said burner box assembly for admitting combustion air to said interior space, a first airflow guide and baffle member mounted in said interior space and adjacent said combustion air inlet opening for receiving and distributing combustion air admitted to said interior space, said first baffle member including plural airflow ports formed therein for distributing combustion air to said interior space and arranged to prevent direct transmission of combustion generated acoustic emissions to the exterior of said burner box assembly through said combustion air inlet opening, and a second airflow guide and baffle member mounted on the exterior of said burner box assembly and adjacent said combustion air inlet opening, said baffle members being arranged to reduce acoustic emissions from said burner box assembly.

14. The furnace set forth in claim 13 wherein:

said second baffle member includes opposed airflow ports formed thereby for admitting combustion air to said combustion air inlet opening of said burner box assembly.

15. The furnace set forth in claim 14 wherein:

said combustion air inlet opening is disposed in said top wall of said burner box assembly and said second baffle member is mounted on said top wall and disposed directly over said combustion air inlet opening.

16. The furnace set forth in claim 14 wherein:

a total cross sectional flow area of said opposed airflow ports of said second baffle member for admitting combustion air to said burner box assembly is about the same as a total cross sectional flow area provided by said plural airflow ports in said first baffle member.

17. The furnace set forth in claim 16 wherein:

a cross sectional flow area of said combustion air inlet opening is not substantially less than said total cross sectional flow area of said airflow ports in said first baffle member or said second baffle member.

18. An air heating furnace comprising:

a cabinet;

a heat exchanger mounted in said cabinet;

a partition defining a wall of a heat exchanger enclosure of said furnace; and a burner box assembly mounted at said partition, said burner box assembly including a back wall, a top wall, a bottom wall, opposed sidewalls and an open end, at least one burner nozzle mounted within an interior space of said burner box assembly, a combustion air inlet opening formed in one of said walls of said burner box assembly for admitting combustion air to said interior space, a first airflow guide and baffle member mounted in said interior space and adjacent said combustion air inlet opening for receiving and distributing combustion air admitted to said interior space, said first baffle member including a bottom wall, opposed sidewalls, an end wall and plural airflow ports formed in said bottom wall spaced apart and arranged for admitting combustion air to said interior space in a distributed manner, and plural spaced apart louvers disposed, respectively, adjacent said airflow ports in said bottom wall, respectively, and disposed to substantially prevent direct transmission of acoustic emissions from combustion in said furnace to the exterior of said burner box assembly through said combustion air inlet opening, and a second airflow guide and baffle member mounted on the exterior of said burner box assembly and adjacent said combustion air inlet opening, said baffle members being arranged to reduce acoustic emissions from said burner box assembly.

* * * * *